US006125527A

United States Patent [19]

Sunaga et al.

[11] Patent Number: 6,125,527

[45] **Date of Patent: *Oct. 3, 2000**

[54] PROCESS FOR PRODUCING PRECISE CUT SURFACES

[75] Inventors: Junichi Sunaga, Sagamihara, Japan; Wolfgang Rose, Seedorf, Switzerland

[73] Assignee: Feintool International Holding, Lyss, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/987,535

[22] Filed: Dec. 9, 1997

[30] Foreign Application Priority Data

Sep. 4, 1997 [DE] Germany ..... 197 38 635

[51] Int. Cl.[7] ..... B23P 13/04

[52] U.S. Cl. ..... 29/558; 72/334; 72/335

[58] Field of Search ..... 72/325, 335, 334, 72/336, 337, 327, 339, 340, 404; 29/558, 893.3, 893.35, 874

[56] References Cited

U.S. PATENT DOCUMENTS

| | | | |
|---|---|---|---|
| 1,325,194 | 12/1919 | Geist | 72/325 |
| 3,724,305 | 4/1973 | Kondo | 83/14 |
| 3,739,669 | 6/1973 | Seki . | |
| 3,878,746 | 4/1975 | Carmeli . | |
| 4,362,078 | 12/1982 | Ohnishi et al. | 83/862 |
| 4,586,360 | 5/1986 | Jurgensmeyer et al. . | |
| 4,711,115 | 12/1987 | Sukonnik et al. . | |
| 5,105,696 | 4/1992 | Baubles | 83/35 |
| 5,247,862 | 9/1993 | Haack | 83/27 |
| 5,263,353 | 11/1993 | Bakermans et al. | 72/334 |
| 5,320,013 | 6/1994 | Nonami et al. . | |
| 5,803,854 | 9/1998 | Tada et al. | 474/213 |

FOREIGN PATENT DOCUMENTS

| | | |
|---|---|---|
| 665367 | 5/1988 | Switzerland . |

OTHER PUBLICATIONS

English translation of Swiss Patent No. 665,367 (15 pages), May 1988.

*Primary Examiner*—David P. Bryant
*Attorney, Agent, or Firm*—Bachman & LaPointe, P.C.

[57] ABSTRACT

In a process for producing precise cut surfaces on a workpiece by stamping or blanking, in particular by fine-edge blanking, a contour first is stamped or blanked out at a distance (a) from the actual contour of the workpiece, and the workpiece then is scraped down to its final contour. It is intended here, in a first step, for only up to part of the thickness (d) of the workpiece to be scraped and, in a following step, for the contour of the workpiece to be achieved by scraping in the opposite direction to the first step.

4 Claims, 3 Drawing Sheets

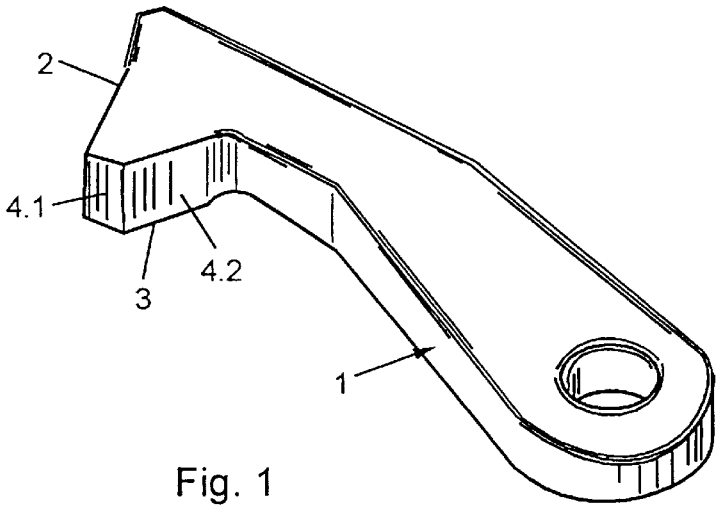
Fig. 1
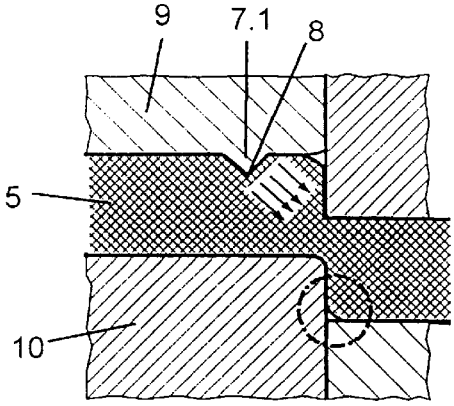
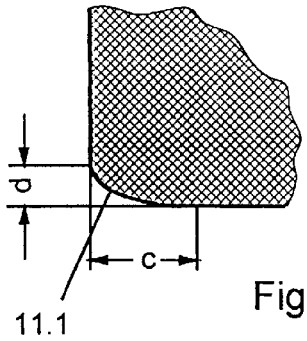
Fig. 3
Fig. 2
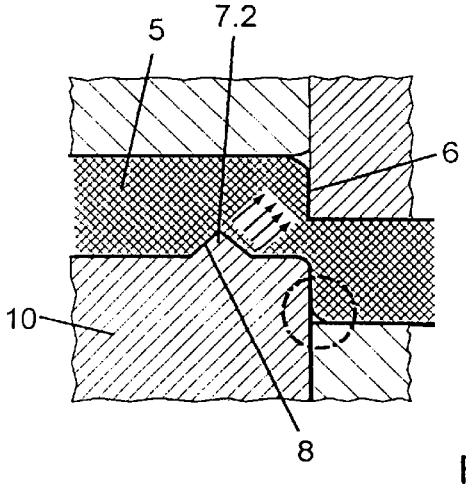
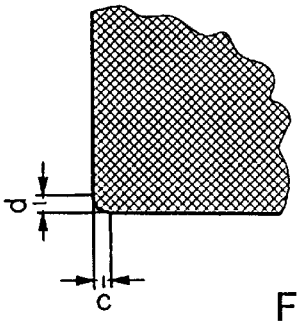
Fig. 5
Fig. 4

PROCESS FOR PRODUCING PRECISE CUT SURFACES

BACKGROUND OF THE INVENTION

The invention relates to a process for producing precise cut surfaces on a workpiece by stamping or blanking, in particular by fine-edge blanking, a contour first being stamped or blanked out at a distance from the actual contour of the workpiece, and the workpiece then being scraped down to its final contour.

Although in the present case the description relates essentially to so-called fine-edge blanking, the invention is also intended to encompass a normal stamping operation, in which the process according to the invention may be used.

Unlike in normal stamping, fine-edge blanking makes it possible to produce parts which have a cut surface which is almost 100% smooth. Even when fine-edge blanking, process conditions mean that there is an edge reduction on the component cut surface which faces the cutting tip and a burr on the side opposite to the edge reduction. This edge reduction and burr is dependent mainly on the geometric shape of the component, but also on the material and the thickness of the component. They are considerably larger with a projecting corner than with a reentrant corner. The major advantage of a component produced by the fine-edge blanking process consists, in addition to the smooth cut surface, in the fact that the component cut surface is hardened.

For functional shapes of fine-edged blanks, there is a recurring need for only a slight or small edge reduction. The projecting, acute-angled shapes of the fine-edged blanks have a large reduction, such as for example pawl teeth or gear wheels. An edge reduction produced at the cut surface of a fine-edged blank and a burr situated on the opposite side from the edge reduction are removed by shaving. This results in an enlarged bearing portion of the functional area; this means that the component can be subjected to higher loads or, if the loading level is predetermined, thinner sheet thicknesses can be used.

By way of example, CH 665 367 A2 describes a shaving process in which the shaving is carried out in the cutting direction, or counter to the cutting direction, of the preceding fine-edge blanking operation. This means that the actual desired contour of the workpiece to be produced is approached in a number of steps. The significant disadvantage which has emerged for this process is that the shaving produces chips which remain in the tool or in the press, and over the course of time these lead to considerable operating problems.

SUMMARY OF THE INVENTION

The object underlying the present invention is to develop a process of the abovementioned type in which the drawback of the chips remaining in the tool does not arise.

This object is achieved in that in a first step, the workpiece is only scraped down to part of its thickness and, in a following step, the contour of the workpiece is reached by further scraping.

The essential advantage of this process is that the chip reliably remains on the strip of material and is removed from the tool or the press together with this strip of material, i.e. the blanking skeleton. The chip is not detached from the blanking skeleton, so that there will be no loose chips remaining in the workpiece.

A further significant advantage lies in the fact that, on the one hand, the reduction caused by the fine-edge blanking is filled up again during the final scraping step, which is carried out in the opposite direction to the fine-edge blanking direction, and at the same time the scraping causes only a slight reduction by comparison with the reduction caused by fine-edge blanking. The burr is likewise completely removed.

In contradistinction to fine-edge blanking, which is carried out through the entire blanking skeleton, scraping, which is carried out only on an already existing surface, requires a lower force. The lower force also makes it possible to produce smaller corner roundings than when fine-edge blanking while subjecting the material to the same level of loading.

Preferably, the first scraping step is carried out to beyond half the thickness of the workpiece. The result is a favorable distribution of force, since by the second scraping step half of the material to be scraped has already been converted into a chip.

Furthermore, the first scraping step should also be carried out over at least half the distance between a pawl-tooth hole and the actual desired contour of the tooth. The complete distance is then removed in the second step.

The invention is also intended to encompass the possibility of carrying out the scraping in a number of steps, in or counter to the direction of blanking or stamping. This is dependent primarily on the material which is used for the workpiece.

BRIEF DESCRIPTION OF THE DRAWINGS

Further advantages, features and details of the invention will emerge from the following description of preferred exemplary embodiments and with reference to the drawing, in which FIG. 1 shows a perspective view of a fine-edge blanked and scraped pawl;

FIG. 2 shows a diagrammatic illustration of a fine-edge blanking operation;

FIG. 3 shows an enlarged detail from FIG. 2;

FIG. 4 shows a diagrammatic illustration of the fine-edge blanking operation in another exemplary embodiment;

FIG. 5 shows an enlarged detail from FIG. 4;

DETAILED DESCRIPTION

Figure 6:
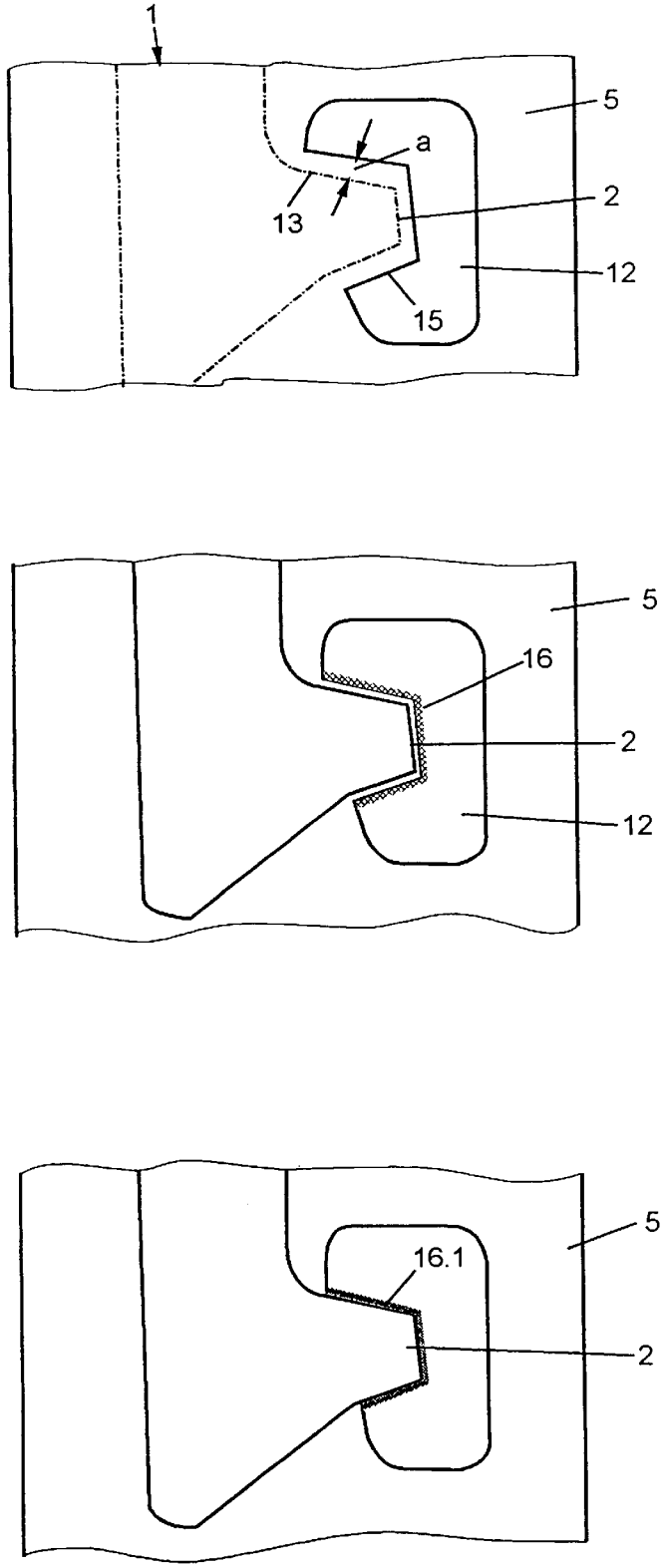
FIG. 6 shows a diagrammatic illustration of a scraping operation carried out on the fine-edge blanked tooth of the pawl in accordance with FIG. 1.

FIG. 1 depicts a fine-edge blanked pawl 1, the tooth 2 of which has been additionally shaved or scraped. Scraping of an already blanked shape also relates to the internal forming and external forming of a continuous cut-line contour, and is not restricted solely to tooth parts as illustrated in FIG. 1.

The tooth contours are provided with sharp edges 3, tooth cut surfaces 4.1 and 4.2 being right-angled, free of edge reductions and with only little burring.

The fine-edge blanking operation is illustrated diagrammatically in FIGS. 2 to 5. Prior to the actual fine-edge blanking operation, a notch 8 is made in a material strip 5, outside a cut line 6, by means of a knife-edged ring 7. The knife-edged ring 7 may be formed integrally either on a guide plate 9 or a cutting tip 10, or on both a guide plate 9 and a cutting tip 10 (not illustrated) of the fine-edge blanking tool.

As can be seen from FIGS. 3 and 5, applying the knife-edged ring 7.1 or 7.2 reduces the edge reduction at the cut surface of the fine-edged blank 1. In particular, the edge reduction is decreased significantly by the last-mentioned measure, i.e. arranging the knife-edged ring 7.1 and 7.2 both on the guide plate 9 and on the cutting tip 10; however, for production and maintenance reasons this measure is expensive. The reduction width which can be seen in FIGS. 3 and 5 is designated by c and the reduction depth of the edge reduction 11.1 is designated by d.

Figure 7:
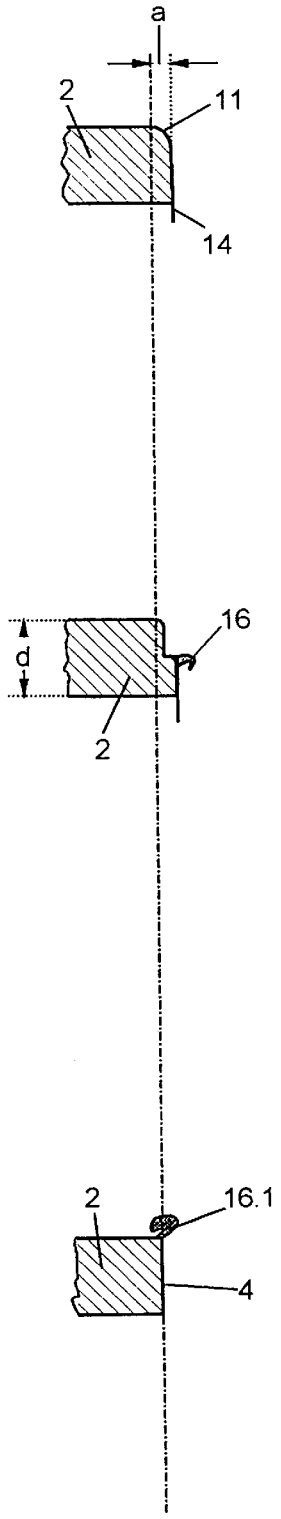
FIG. 7 shows a side view of a diagrammatic illustration of the scraping operation according to the invention in accordance with FIG. 6.

FIGS. 6 and 7 diagrammatically illustrate the rescraping operation on the cut surface 4.1 or 4.2 of the fine-edge blanked pawl tooth 2. To carry out this operation, in a first working step a pawl-tooth hole 12 is formed in the material strip 5, this hole 12 maintaining a distance a from a contour 13, which is indicated in dot-dashed lines, of the pawl tooth 2. FIG. 7 shows the edge reduction 11 and a burr 14 situated on the opposite side from the edge reduction 11. The pawl-tooth hole 12 is blanked out in the cutting direction x.

The next step involves scraping in the region of the distance a between the contour 13 of the pawl tooth 2 and the first inner contour 15 of the pawl-tooth hole 12. This stage involves scraping by about half the distance a and down to approximately half the thickness d of the tooth 2. The result is a chip 16, but this chip remains on the tooth 2.

A final working step involves scraping, counter to the cutting direction x, by the entire dimension of the distance a, so that now both the edge reduction 11 and also the burr 14 have been eliminated and there is a precise cut surface 4 on the tooth 2. However, the chip 16.1 remains on the material strip 5 and is removed from the corresponding tool together with this material strip 5.

Figure 8:
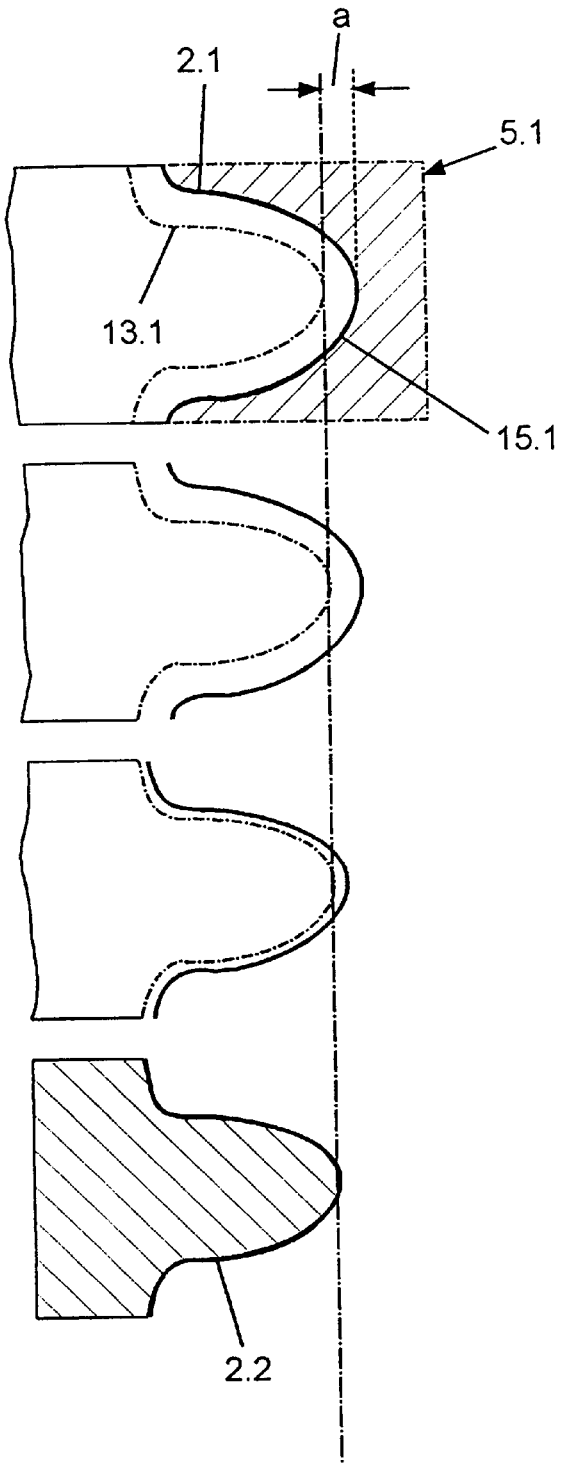
FIG. 8 shows a diagrammatic illustration of a scraping operation corresponding to FIG. 6 in a further exemplary embodiment.
Figure 9:
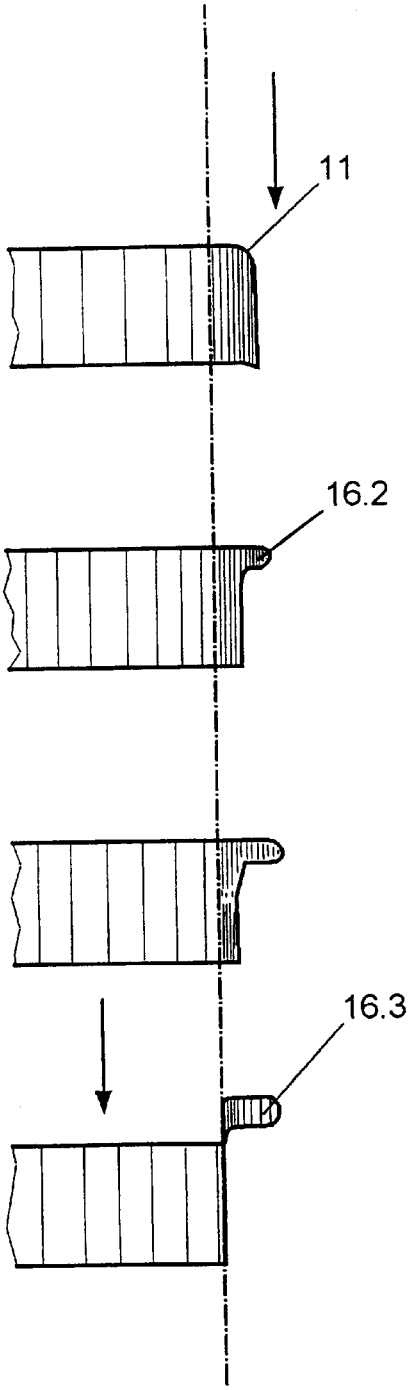
FIG. 9 shows a side view of a diagrammatic illustration of the scraping operation in accordance with FIG. 8.

FIGS. 8 and 9 show a further exemplary embodiment of a scraping process according to the invention. In the first part of the figures, a tooth 2.1 is stamped out of a material strip 5.1, the first inner contour 15.1 maintaining the distance a from a desired, final contour 13.1. The stamping direction is indicated by the arrow in FIG. 9.

A second step involves a first scraping operation, specifically counter to the stamping direction, so that the edge reduction 11 is compensated for and material scraped there accumulates as chip 16.2.

A second scraping operation again involves scraping, counter to the stamping direction, over a further part of the distance a, and then a final scraping step is carried out counter to the stamping direction, the finished tooth 2.2 simultaneously being ejected downwards. The chip 16.3 remains attached to the material strip 5.1 or the blanking skeleton.

What is claimed is:

1. A process for forming a final fine-edge on a workpiece of thickness (d) by stamping, comprising the steps of:

stamping a contour on the workpiece at a distance (a) from the final fine-edge to be formed, said stamping being in a first direction;

providing a first scraping partially through the thickness (d) of the workpiece at a distance less than distance (a) from the final edge to be formed on the workpiece in a second direction opposite to the first direction; and rescraping in the first direction through the entire thickness (d) of the workpiece to form the final edge.

2. The process as claimed in claim 1, wherein the first scraping step is carried out to beyond half the thickness (d) of the workpiece.

3. The process as claimed in claim 1, wherein further scraping is carried out in a plurality of passes.

4. A process as claimed in claim 1, wherein the first scraping step is carried out proximate to the final edge.

* * * * *